United States Patent [19]

Oguni et al.

[11] 4,423,603

[45] Jan. 3, 1984

[54] HEAT PUMP TYPE REFRIGERATION SYSTEM

[75] Inventors: Kensaku Oguni, Shimizu; Hiromu Yasuda, Shizuoka; Sigeaki Kuroda, Shimizu, all of Japan

[73] Assignee: Hitachi, Ltd., Tokyo, Japan

[21] Appl. No.: 382,561

[22] Filed: May 27, 1982

[30] Foreign Application Priority Data

May 29, 1981 [JP] Japan ..... 56-81172

[51] Int. Cl.[3] ..... F25B 13/00

[52] U.S. Cl. ..... 62/324.1; 62/114; 62/324.4; 62/502

[58] Field of Search ..... 62/114, 324.1, 324.4, 62/502

[56] References Cited

U.S. PATENT DOCUMENTS

| | | | |
|---|---|---|---|
| 2,799,142 | 7/1957 | Schubert et al. | 62/502 X |
| 2,938,362 | 5/1960 | Schwind | 62/114 X |
| 3,203,194 | 8/1965 | Fuderer | 62/502 X |
| 4,106,307 | 8/1978 | Matsuda | 62/324.4 |
| 4,179,898 | 12/1979 | Vakil | 62/114 |

*Primary Examiner*—Lloyd L. King

*Attorney, Agent, or Firm*—Antonelli, Terry & Wands

[57] ABSTRACT

A heat pump type refrigeration system for air conditioners. The system has a heat pump type refrigeration circuit including a compressor the suction side and discharge side of which are switchably connected to an indoor heat exchanger and an outdoor heat exchanger through a four-way valve. The other sides of the heat exchangers are connected to each other through a first pressure reducer, gas-liquid separator and a second pressure reducer. A refrigerant tank is disposed in a pipe interconnecting the four-way valve and the indoor heat exchanger, in a heat exchanging relation to the pipe. The gas-liquid separator is connected at its upper portion to the refrigerant tank. The heat pump type refrigerant circuit confines a bi-component refrigerant consisting of two refrigerants of different boiling temperatures.

12 Claims, 7 Drawing Figures

HEAT PUMP TYPE REFRIGERATION SYSTEM

BACKGROUND OF THE INVENTION

The present invention relates to a heat pump type refrigeration system for use in air conditioning system or the like equipment, having a heat pump type refrigeration circuit confining a refrigerant mixture.

The heat pump type refrigeration system for air conditioners basically consists of a compressor, four-way valve, indoor heat exchanger, pressure reducer for cooling, pressure reducer for heating and an outdoor heat exchanger which are connected in sequence. The switching between the cooling operation and the heating operation is made by reversing the flow of refrigerant in the refrigeration circuit by suitably operating the four-way valve. Namely, during the cooling operation, the refrigerant discharged from the compressor is recirculated to the compressor through the four-way valve, outdoor heat exchanger, cooling pressure reducer, indoor heat exchanger and then through the four-way valve. In this case, the outdoor heat exchanger serves as a condenser, while the indoor heat exchanger serves as an evaporator. To the contrary, during the heating operation, the refrigerant discharged from the compressor is recirculated to the same through the four-way valve, indoor heat exchanger, heating pressure reducer, outdoor heat exchanger and through the four-way valve. In this case, the indoor heat exchanger functions as the condenser, while the outdoor heat exchanger functions as an evaporator. If the ambient air temperature is low and the humidity is high during the heating operation, there is a tendency that the surface of the outdoor heat exchanger is frosted to restrict the passage for air to decrease the flow rate of air resulting in a reduced heating capacity. It is, therefore, necessary to remove the frost, i.e. to effect a defrosting. The defrosting operation is performed by switching the four-way valve to circulate the refrigerant in the same way as the cooling operation.

One of the problems of the heat pump type air conditioner of this type is that the heating power is decreased when the ambient air temperature is lowered during heating operation. As a countermeaure for overcoming this problem, it has been proposed to increase the heating power by increasing the theoretical displacement of the compressor. This, however, unnecessarily increases the refrigeration power to increase the cost of the apparatus.

Another problem is that, since the discharge pressure and the suction pressure are reduced during defrosting, the input to the compressor is also reduced to decrease the heat required for the defrosting, so that the defrosting time is increased impractically. To overcome this problem, it has been proposed to use a bi-component refrigerant having two refrigerant components of different boiling temperatures to improve the energy efficiency.

A heat pump type refrigeration system disclosed in Japanese Patent Publication No. 698/81 preceding to the present application has a plurality of tanks disposed at the inlet or outlet side of the indoor heat exchanger of the refrigeration circuit, and a bi-component refrigerant consisting of two refrigerant components of different boiling temperatures is confined in the refrigeration circuit. The bi-component refrigerant is circulated in the refrigeration circuit during the cooling, while, during the heating, the refrigerant component of higher boiling point is stored in the tanks and the refrigerant component of lower boiling temperature is circulated solely.

In this refrigeration system, the refrigerant component of low boiling point solely is circulated in the refrigeration circuit to function as the working fluid during heating operation, so that the heating power is increased advantageously, but the coefficient of performance in the cooling operation is lowered undesirably.

SUMMARY OF THE INVENTION

Accordingly, an object of the invention is to provide a heat pump type refrigeration system having a refrigerant circuit confining two kinds of refrigerants of different boiling temperatures, wherein, during the heating, the bi-component refrigerant having greater concentration of refrigerant of higher pressure than the other at the same temperature is circulated whereas, during the cooling, the bi-component refrigerant having greater concentration of refrigerant of lower pressure than the other at the same temperature is circulated, so that the coefficient of performance and the heating performance is increased without unnecessarily increasing the refrigeration power, while permitting a shortening of the defrosting time.

To this end, according to the invention, the suction side line and the discharge side line of a compressor are switchably connected through a four-way valve to an outdoor heat exchanger and an indoor heat exchanger while the other sides of these heat exchangers are connected through a first pressure reducer, a gas-liquid separator and a second pressure reducer. A refrigerant tank is disposed in a heat exchanging condition in the line interconnecting the four-way valve and the indoor heat exchanger, and the upper portion of the gas-liquid separator and the refrigerant tank is connected by a pipe to form a heat pump type refrigerant circuit. A bi-component refrigerant consisting of two kinds of refrigerants of different pressure-temperature characteristics is confined in this circuit. During the heating, the bi-component refrigerant having greater concentration of refrigerant of low-boiling point refrigerant having large specific weight of vapor and having higher pressure at the same temperature than the other is circulated in the refrigerant circuit. To the contrary, during cooling, the bi-component refrigerant having greater concentration of high-boiling point refrigerant having smaller specific weight of vapor and the lower pressure at the same temperature than the other is circulated in the refrigerant circuit. These two refrigerants are, for example, monochlorodifluoromethane (R22) and monobromotrifluoromethane (R13B1) having higher pressure, greater specific weight of vapor and lower boiling point than R22 at the same temperature. During the cooling operation, the liquid refrigerant condensed in the outdoor heat exchanger is decompressed in the pressure reducer and is separated in the gas-liquid separator into a liquid refrigerant having greater concentration of R22 and a gaseous refrigerant having greater concentration of R13B1. On the other hand, since the refrigerant tank is cooled by the low-temperature refrigerant discharged from the indoor heat exchanger, the gaseous refrigerant separated in the gas-liquid separator is moved into the refrigerant tank so as to be condensed in the latter. Namely, a liquid refrigerant having greater concentration of R13B1 is collected in the refrigerant tank. In consequence, the refrigerant circulated in the refrigerant circuit has a greater concentration of R22, so that the refrigeration system operates with normal level of cooling power matching the cooling load. On the other hand, during heating, the refrigerant circuit is reversed so that the refrigerant tank is heated by the hot refrigerant to a high temperature. Therefore, in the refrigerant tank, the refrigerant is not condensed but exists in the form of the gaseous refrigerant. Therefore, during the heating, the bi-component refrigerant circulated in the refrigerant circuit has a greater concentration of R13B1 as compared with the cooling operation, so that it is possible to obtain an increased heating power.

In the defrosting operation of the refrigeration system, the refrigerant is circulated through the same line as that in the cooling operation. However, since the refrigerant tank is heated during the heating operation to a high temperature, the gaseous refrigerant in the gas-liquid separator is not condensed in the refrigerant tank even through the operation mode is switched from heating operation to defrosting operation. In coinsequence, the bi-component refrigerant same as that circulated in the heating operation is circulated to provide higher discharge pressure and higher suction pressure of the compressor which in turn permits and increase of the flow rate of refrigerant and, hence, a greater electric power input to the compressor. In consequence, it is possible to shorten the defrosting time.

Another object of the invention is to provide a heat pump type refrigeration system which can increase the heating power and shorten the defrosting time without unnecessarily increasing the cooling power while optimizing the flow rate of the refrigerant circulated in the refrigerant circuit during cooling and heating.

To this end, according to the invention, a second refrigerant tank is disposed in a heat exchanging relation in the line between the four-way valve and the outdoor heat exchanger and the is connected to a liquid tank provided at the bottom of the gas-liquid separator.

During the cooling, the liquid refrigerant condensed in the outdoor heat exchanger during cooling is decompressed in the second pressure reducer so as to be divided into liquid refrigerant having greater concentration of R22 and gaseous refrigerant having a greater concentration of R13B1. In addition, since the first refrigerant tank is cooled by the low-temperature refrigerant discharged from the indoor heat exchanger, the gaseous refrigerant in the gas-liquid separator is condensed in the first refrigerant tank provided that the pressure in the gas-liquid separator is suitably determined. In consequence, liquid refrigerant having greater R13B1 concentration is collected in the first refrigerant tank so that the refrigerant circulated in the refrigerant circuit has greater concentration of R22 so that the system operates with normal cooling power matching the cooling demand or load. In the actual refrigerant circuit, however, the amount of refrigerant in the refrigerant circuit becomes not optimum as the liquid refrigerant is collected in the first refrigerant tank, so that it becomes necessary to readjust the amount of refrigerant. The second refrigerant tank is provided for the readjustment of amount of refrigerant. In the cooling operation, the second refrigerant tank is heated to a high temperature by the hot refrigerant discharged from the compressor 1, so that it cannot store the liquid refrigerant although it is connected to the bottom of the gas-liquid separator. The liquid refrigerant having greater R22 concentration stored in the second refrigerant tank during heating is returned to the refrigerant circuit.

On the other hand, in the heating operation, the first refrigerant tank is heated by the hot refrigerant to a high temperature, so that the gaseous refrigerant is not condensed but exists as the vapor. Meanwhile, the liquid refrigerant in the gas-liquid separator is collected in the second refrigerant tank since the latter is cooled by the low-temperature refrigerant.

As has been described, gaseous refrigerant and liquid refrigerant are accumulated in the first refrigerant tank and the second refrigerant tank, respectively, so that it is possible to optimize the rate of circulation of the refrigerant in the refrigerant circuit. Furthermore, it is possible to circulate during heating the refrigerant having greater R13B1 concentration as compared with the cooling.

In the defrosting operation, the first refrigerant tank is heated to a high temperature by the heat generated during heating operation, the gaseous refrigerant cannot be condensed in the first refrigerant tank, so that it is possible to increase the R13B1 concentration in the refrigerant circulated in the refrigerant circuit in the initial period of defrosting.

The second refrigerant tank is gradually heated during defrosting so that the liquid refrigerant is never stored in the latter. This ensures, in combination with the operation of the first refrigerant tank, a greater rate of circulation of refrigerant in the refrigerant circuit. In consequence, the discharge pressure and the suction pressure of the compressor are increased to increase the electric power input to the compressor, so that the heat available for the defrosting is increased to remarkably shorten the defrosting time.

Still another object of the invention is to provide a heat pump type refrigeration system having, in addition to the aforementioned features of increased heating power and shortening of defrosting time without requiring unnecessary increase of the cooling power, another feature that the composition of the bi-component mixture is further changed between the cooling and heating mode to further ensure the separation of the bi-component refrigerant during cooling and an increase of the heating power during heating.

To this end, the gas-liquid separator is provided in two stages and a heat exchanger is connected between two separators. This heat exchanger is adapted to be cooled by the low-temperature gaseous refrigerant flowing out of the heat exchanger is adapted to be cooled by the low-temperature gaseous refrigerant flowing out of the indoor heat exchanger. In addition, the second gas-liquid separator is connected to the refrigerant tank. In the cooling operation, the gaseous refrigerant having higher R13B1 concentration separated in the first gas-liquid separator is cooled and condensed in the ahove-mentioned heat exchanger and is subjected to a further gas-liquid separation in the second gas-liquid separator. The gaseous refrigerant of still higher R13B1 concentration is introduced into the refrigerant tank so that liquid refrigerant of an extremely high R13B1 concentration is stored in the refrigerant tank. In consequence, refrigerant of high R22 concentration is circulated in the refrigerant circuit so that it is possible to obtain an optimum cooling power while improving the coefficient of performance.

BRIEF DESCRIPTION OF THE DRAWINGS

A preferred form of the invention will be explained hereinunder with reference to the accompanying drawings in which.

DESCRIPTION OF THE PREFERRED EMBODIMENTS

Figure 1:
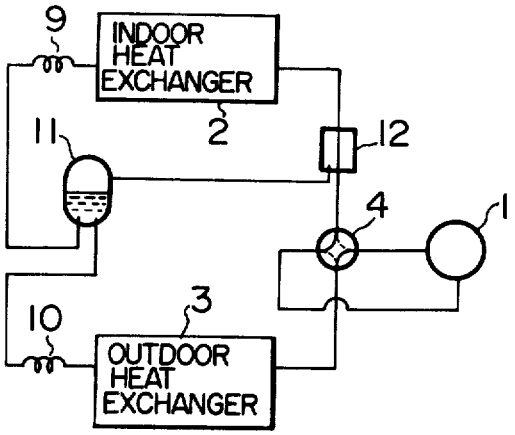
FIG. 1 is a refrigerant circuit diagram of a heat pump type air conditioner constructed in accordance with an embodiment of the invention.

Referring first to FIG. 1, a refrigerant circuit is constituted by a compressor 1, indoor heat exchanger 2, outdoor heat exchanger 3, four-way valve 4, first pressure reducer 9, second pressure reducer 10, gas-liquid separator 11 and a refrigerant tank 12 connected in sequence as illustrated. The four-way valve 4 is switched between two modes: namely, a cooling operation as shown by full line and a heating operation shown by broken lines.

Figure 2:
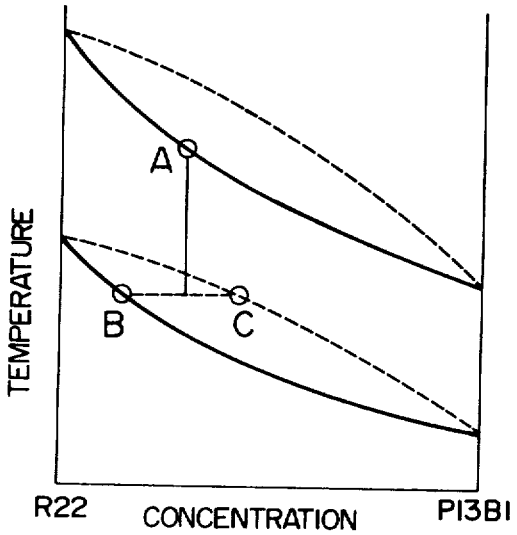
FIG. 2 is a diagram showing the relation between the concentration of bi-component refrigerant in the refrigerant circuit shown in FIG. 1 and the temperature.
Figure 3:
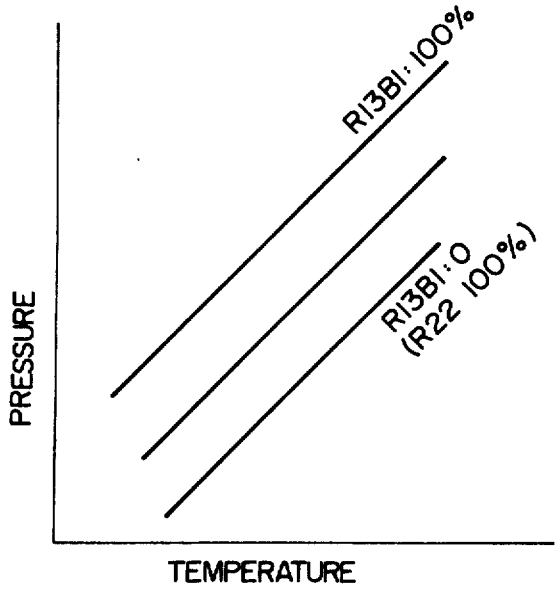
FIG. 3 is a diagram showing the relationship between the temperature and the pressure of the mixture refrigerant.
Figure 4:
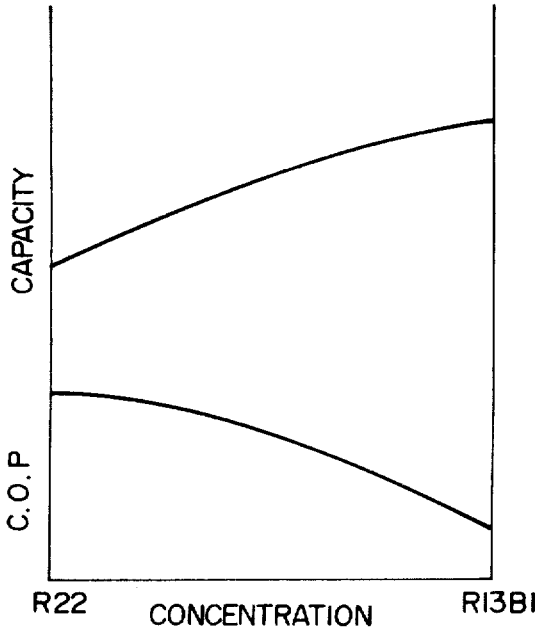
FIG. 4 is a diagram showing the relationship between the concentration of refrigerant and the coefficient of performance.

The refrigerant tank 12 is disposed for a heat exchanging relation to the pipe interconnecting the four-way valves 4 and the indoor heat exchanger 2. Namely, the refrigerant tank 12 is fixed to the pipe by, for example, welding or, alternatively, the tank is formed to surround the outer peripheral surface of the pipe. The refrigerant tank 12 is connected to the upper portion of the gas-liquid separator 11. A bi-component refrigerant consisting of two refrigerants of different pressure-saturation temperature characteristics is confirned in this refrigerant circuit. In the description of this embodiment, it is assumed that these refrigerants are R22 and R13B1 which exhibits higher pressure than R22 at the same temperature and having greater specific weight of vapor, as well as lower boiling temperature. FIG. 2 shows the relationship between the concentration and temperature, while FIG. 3 shows the relationship between the temperature and pressure of the bi-component refrigerant. From FIG. 2, it will be seen that, at the same pressure and temperature, there is a coexistence of a liquid refrigerant of high R22 concentration as at point B and gaseous refrigerant having greater R13B1 concentration as at point C. From FIG. 3, it will be seen that the pressure is increased as the R13B1 concentration becomes higher, provided that the temperature is maintained unchanged. FIG. 4 shows the coefficient of performance and refrigeration power as obtained when the bi-component refrigerant is used. The coefficient of performance is decreased as the R13B1 concentration is increased but the refrigeration power is increased.

The embodiment shown in FIG. 1 operates in a manner explained hereinunder. In the cooling operation, the liquid refrigerant discharged from the compressor 1 is circulated through the four-way valve 4, outdoor heat exchanger 3, second pressure reducer 10, gas-liquid separator 11, first pressure reducer 9, indoor heat exchanger 2, four-way valve 4 and the compressor 1. The operation of the gas-liquid separator 11 will be explained with specific reference to FIG. 2. The liquid refrigerant condensed by the outdoor heat exchanger 3 is denoted at A. This liquid refrigerant is decompressed in the second pressure reducer 10 so as to be divided into liquid refrigerant having higher R22 concentration denoted at B and gaseous refrigerant of higher R13B1 concentration denoted at C. On the other hand, since the refrigerant tank 12 is cooled by the low-temperature refrigerant coming out of the indoor heat exchanger 2, the gaseous refrigerant in the gas-liquid separator 11 is condensed in the refrigerant tank 12 provided that the pressure in the gas-liquid separator 11 is suitably selected, so that the liquid refrigerant having high R13B1 concentration is collected in the refrigerant tank 12. Therefore, the bi-component refrigerant circulated in the refrigeration cycle has a high R22 concentration so that the refrigeration system as a whole can operate under a substantially equal condition as the conventional refrigeration system and provides a substantially equivalent cooling effect to that achieved by the conventional refrigeration system.

On the contrary, in the heating operation of the heat pump type refrigeration system of this embodiment, the refrigerant discharged from the compressor 1 is recycled to the compressor 1 through the four-way valve 4, indoor heat exchanger 2, first pressure reducer 9, gas-liquid separator 11, second pressure reducer 10, outdoor heat exchanger 3 and the four-way valve 4. As in the case of the cooling operation, the refrigerant is divided in the gas-liquid separator 11 into liquid refrigerant having greater R22 concentration and gaseous refrigerant having greater R13B1 concentration. The refrigerant tank 12 is heated to high temperature by the heat derived from the hot refrigerant, so that the refrigerant in the refrigerant tank is never condensed but exists in the form of vapor. Therefore, in the heating operation, the bi-component refrigerant circulated in the refrigerant circuit has a greater R13B1 concentration than in the cooling operation, so that the heating power is increased advantageously.

In the defrosting operation, the four-way valve 4 is switched to permit the refrigerant to be circulated in the same line as that in the cooling operation. However, since the refrigerant tank 12 is heated to a high temperature during heating operation, the vapor in the gas-liquid separator 11 is never condensed even though the operation mode is switched from heating operation to defrosting operation. Therefore, during defrosting, the bi-component refrigerant having an R13B1 concentration as high as that in the heating operation is circulated. In consequence, the discharge pressure and the suction pressure of the compressor are increased as shown by broken lines in FIG. 2, and the flow rate of refrigerant is also increased to require greater electric power input to the compressor. In consequence, the time length of defrosting operation is shortened advantageously. This effect will be further increased by providing the refrigerant tank 12 with suitable heat capacity.

As will be understood from the foregoing description, according to the invention, the heating power is increased and the defrosting time is shortened advantageously while maintaining refrigeration power equivalent to that of the normal operation with a mono-component refrigerant. In consequence, according to the invention, it is possible to obtain an improved comfort and to save electric power.

Figure 5:
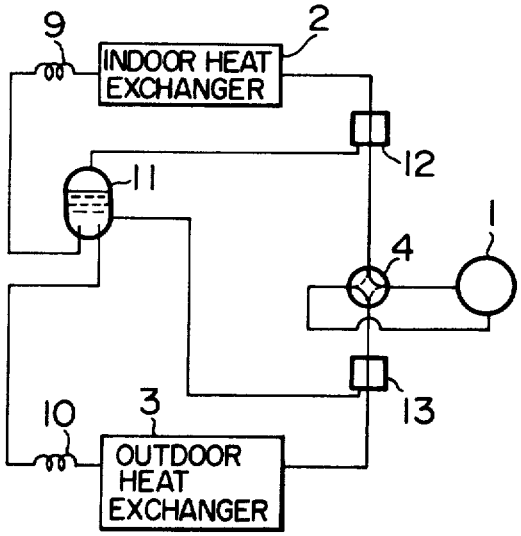
FIG. 5 is a refrigerant circuit diagram of a refrigerant system of another embodiment having a second refrigerant tank.

FIG. 5 shows another embodiment of the invention which differs from the embodiment shown in FIG. 1 in that a second refrigerant tank 13 is disposed in a heat exchanging relation to the pipe connected between the four-way valve 4 and the outdoor heat exchanger 3. This refrigerant tank 13 is connected to the liquid tank provided at the bottom of the gas-liquid separator. Other portions including the confinement of bi-component refrigerant consisting of two refrigerant of different boiling temperatures are identical to those in the embodiment shown in FIG. 1.

In the cooling operation of this embodiment, the refrigerant discharged from the compressor 1 is recycled to the same through the four-way valve 4, outdoor heat exchanger 3, second pressure reducer 10, gas-liquid separator 11, first pressure reducer 9, indoor heat exchanger 2 and the four-way valve 4. The operation of the gas-liquid separator 11 will be explained hereinunder with specific reference to FIG. 2. The liquid refrigerant condensed in the outdoor heat exchanger 3 is denoted at A, which in turn is separated in the second pressure reducer to liquid refrigerant having higher R22 concentration denoted by B and gaseous refrigerant having higher R13B1 concentration designated at C. On the other hand, since the first refrigerant tank 12 is cooled by the low-temperature refrigerant coming from the indoor heat exchanger 2, the gaseous refrigerant in the gas-liquid separator 11 is condensed in the first refrigerant tank 12 by suitably selecting the pressure in the gas-liquid separator 11. In consequence, liquid refrigerant having higher R13B1 concentration is collected in the first refrigerant tank 12. This means that the bi-component circulated in the refrigeration circuit has a high R22 concentration so that the refrigeration system can operate substantially under the same condition and with substantially equal refrigeration power and the coefficient of performance as the conventional system making use of a mono-component refrigerant.

In the actual refrigeration cycle, however, the amount of the refrigerant in the refrigeration cycle becomes not optimum as the liquid refrigerant is accumulated in the first refrigerant tank 12, so that it becomes necessary to effect a suitable readjustment. The second refrigerant tank is intended for permitting this readjustment. The ratio of the internal volume of the second refrigerant tank 13 to that of the first tank 12 can be optimumly determined for respective systems. In the cooling operation, the second refrigerant tank 13 can never accumulate the liquid refrigerant although connected to the lower part of the gas-liquid separator 11 because it is heated to a high temperature by the hot refrigerant discharged from the compressor 1. In consequence, the liquid refrigerant having high R22 concentration, which has been stored in the second refrigerant tank during heating, is returned to the refrigerant circuit.

In the heating operation, the refrigerant discharged from the compressor 1 is recirculated to the same through the four-way valve 4, indoor heat exchanger 2, first pressure reducer 9, gas-liquid separator 11, second pressure reducer 10, outdoor heat exchanger 3 and the four-way valve 4. As in the case of the cooling operation, the refrigerant is separated in the gas-liquid separator 11, into liquid refrigerant having higher R22 concentration and gaseous refrigerant having higher R13B1 concentration. Since the refrigerant tank 12 has been heated to a high temperature by the hot refrigerant, the refrigerant tank 12 is never condensed but exists in the form of vapor. Meanwhile, the second refrigerant tank 13 receives liquid refrigerant of high R22 concentration. As has been described, in the heat pump type refrigeration system of the described embodiment, the first and second refrigerant tanks 12 and 13 store the gaseous refrigerant and liquid refrigerant, respectively, so that it is possible to optimize the amount of refrigerant in the refrigeration cycle. In addition, the heating power can be increased because the circulated refrigerant has a high R13B1 concentration as compared with that used in the cooling operation.

In the defrosting operation, the refrigerant is circulated in the same line as that in the cooling operation by the suitable operation of the four-way valve 4. However, since the first refrigerant tank 12 has been heated to a high temperature during the heating operation, the vapor in the gas-liquid separator 11 is never condensed in the refrigerant tank so that it is possible to obtain high R13B1 concentration in the refrigeration cycle in the beginning period of defrosting. The second refrigerant tank 13 is gradually heated during defrosting so that it becomes usable to store liquid refrigerant. This serves, in combination with the effect of the first refrigerant tank 12, to increase the amount of refrigerant in the refrigeration cycle. Furthermore, since the R13B1 concentration is high and the amount of refrigerant is large during defrosting, the discharge pressure and the suction pressure of the compressor are increased and the electric power input to the compressor is increased to permit a remarkable shortening of the defrosting time.

Figure 6:
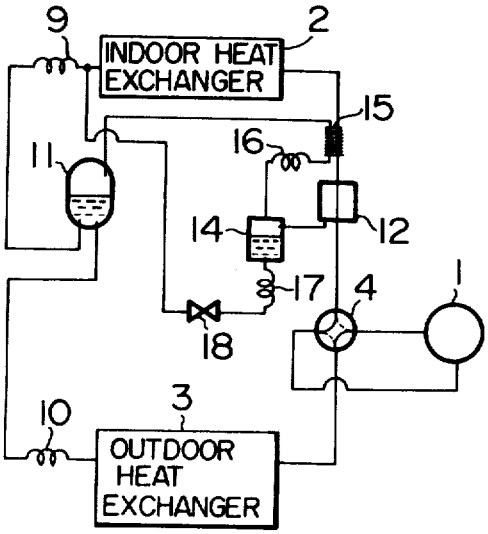
FIG. 6 is a refrigerant circuit diagram of still another embodiment having two stages of gas-liquid separator with a heat exchanger connected therebetween.

FIG. 6 shows a further embodiment of the invention in which the composition of the bi-component refrigerant is further changed between the cooling operation mode and the heating operation mode, thereby to achieve higher effect.

In this Figure, the gaseous phase portion in the upper part of the gas-liquid separator 11 is connected to a heat exchanger 15 through a pipe. The heat exchanger 15 is disposed in a heat exchanging relation to the pipe interconnecting the four-way valve 4 and the indoor heat exchanger 2. The other end of the heat exchanger 15 is connected to a third pressure reducer 16 the other end of which is connected to an upper portion of the second gas-liquid separator 14. A pipe connected to the bottom of the second gas-liquid separator 14 is provided at its intermediate portion with a fourth pressure reducer 17 and a stop valve 18, and is connected to a pipe interconnecting the indoor heat exchanger 2 and the first pressure reducer 1. The refrigerant tank 12 is disposed in a heat-exchanging relation to the pipe between the four-way valve 4 and the indoor heat exchanger. The lower portion of the refrigerant tank 12 is connected to the upper portion of the second gas-liquid separator 14.

The stop valve 18 is adapted to be opened during heating operation but to be closed during cooling as the refrigerant tank 12 is filled with liquid refrigerant. Other portions are substantially identical to those of the embodiment shown in FIG. 1, so that the detailed description of these parts are omitted with same reference numerals used for denoting such portions.

Figure 7:
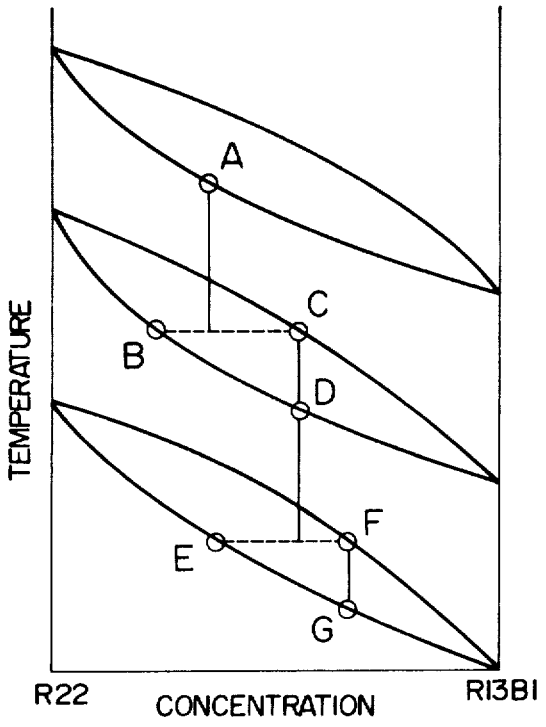
FIG. 7 is a diagram showing the relationship between the concentration and temperature of the bi-component refrigerant confined in the refrigerant circuit shown in FIG. 6.

The cooling operation of this refrigeration system will be explained with specific reference to FIG. 7 showing the diagram representing the relationship between the concentration of bi-component refrigerant and the temperature. The refrigerant liquefied in the outdoor heat exchanger 3 is decompressed in the second pressure reducer 10 and is separated into liquid refrigerant having large R22 concentration designated at B and gaseous refrigerant having high R13B1 concentration designated at C. The gaseous refrigerant C is condensed by the heat exchanger 15 to take the state shown by D and is further decompressed by the third pressure reducer 16. The condensed refrigerant is then separated into liquid refrigerant having high R22 concentration and gaseous refrigerant designated at F having higher R13B1 concentration than that at the point C. The gaseous refrigerant designated at F is condensed in the refrigerant tank 12 to become liquid refrigerant as designated at G. The liquid refrigerant designated at E is introduced into the inlet side of the indoor heat exchanger 2 through the stop valve 18. In this process, as the stop valve 18 is closed when the refrigerant tank 12 becomes full with the liquid refrigerant, a bi-component refrigerant having a higher R22 concentration than that in the embodiment shown in FIG. 1 is circulated in the refrigerant circuit. Therefore, it is possible to obtain the condition and performance of the refrigeration system substantially equivalent to those obtain with pure R22 refrigerant. In the heating operation, since the heat exchanger 15 and the refrigerant tank 12 are heated equally to the case of FIG. 1, the gaseous refrigerant is circulated to permit an increase in the heating power. In addition, an equivalent effect is obtained in the defrosting operation to that performed by the embodiment shown in FIG. 1.

As will be seen from FIG. 7, it is possible to store liquid refrigerant having an extremely high R13B1 concentration by increasing the number of the heat exchanging steps shown in FIG. 6.

Although some preferred forms of the invention have been described on the assumption that the two refrigerants forming the bi-component refrigerant are R22 and R13B1, it will be clear to those skilled in the art that substantially equivalent effect can be obtained even with other kinds of refrigerant.

What is claimed is:

1. A heat pump type refrigeration system comprising a heat pump type refrigeration circuit including: a compressor having a suction-side line and a discharge-side line; a four-way valve; an outdoor heat exchanger and an indoor heat exchanger to which said suction-side line and discharge-side line of said compressor are connected switchably through said four-way valve, the other ends of said heat exchangers being connected to each other through a first pressure reducer, bottom of the gas-liquid separator and a second pressure reducer; a refrigerant tank disposed in a pipe interconnecting said four-way valve and said indoor heat exchanger, in a heat exchanging relation to the pipe interconnecting the four way valve and the indoor heat exchanger; and a pipe interconnecting an upper portion of said gas-liquid separator and said refrigerant tank; said refrigeration system further comprising a bi-component refrigerant mixture confined in said refrigerant circuit and consisting of two refrigerants of different boiling temperatures.

2. A heat pump type refrigerant system as claimed in claim 1, wherein said refrigerants constituting said bi-component refrigerant are R22 are R13B1.

3. A heat pump type refrigeration system as claimed in claim 1, wherein said refrigerant tank is mounted in contact with said pipe.

4. A heat pump type refrigeration system as claimed in claim 1, wherein said refrigerant tank is disposed to surround the outer periphery of said pipe.

5. A heat pump type refrigeration system comprising a heat pump type refrigeration circuit including, a compressor having a suction-side line and a discharge-side line; a four-way valve; an outdoor heat exchanger and an indoor heat exchanger to which said suction-side line and discharge-side line of said compressor are connected switchably through said four-way valve, the other ends of said heat exchangers being connected to each other through a first pressure reducer, bottom of the gas-liquid separator and a second pressure reducer; a first refrigerant tank disposed in a pipe interconnecting said four-way valve and said indoor heat exchanger, in a heat exchanging relation to the pipe interconnecting the four-way valve and the indoor heat exchanger; a second refrigerant tank disposed in the pipe interconnecting said four-way valve and said outdoor heat exchanger in heat exchanging relation to said pipe; a pipe interconnecting an upper portion of said gas-liquid separator and said refrigerant tank; and a pipe interconnecting the bottom of said gas-liquid separator and said second refrigerant tank; said refrigeration system further comprising a bi-component refrigerant confined in said refrigerant circuit and consisting of two refrigerants of different boiling temperatures.

6. A heat pump type refrigerant system as claimed in claim 5, wherein said refrigerants constituting said bi-component refrigeratnt are R22 and R13B1.

7. A heat pump type refrigeration system as claimed in claim 5, wherein said refrigerant tank is mounted in contact with said pipe.

8. A heat pump type refrigeration system as claimed in claim 5, wherein said refrigerant tank is disposed to surround the outer periphery of said pipe.

9. A heat pump type refrigeration system comprising a heat pump type refrigeration circuit including: a compressor having a suction-side line and a discharge-side line; a four-way valve; an outdoor heat exchanger and an indoor heat exchanger to which said suction-side line and discharge-side line of said compressor are connected switchably through said four-way valve, the other ends of said heat exchangers being connected to each other through a first pressure reducer, bottom of a gas-liquid separator and a second pressure reducer; a heat exchanger and a refrigerant tank disposed in a pipe interconnecting said four-way valve and said indoor heat exchanger, in a heat exchanging relation to the pipe interconnecting the four-way valve and the indoor heat exchanger; a pipe interconnecting an upper portion of said gas-liquid separator and a second gas-liquid separator and having said heat exchanger and a third pressure reducer therein, a pipe interconnecting an upper part of said second gas-liquid separator and said refrigerant tank; and a pipe extending from a lower portion of said second gas-liquid separator and having a fourth pressure reducer and a stop valve, said pipe extending from the lower portion of said second gas-liquid separator being connected to a pipe interconnecting said indoor heat exchanger and said first pressure reducer; said refrigeration system further comprising a bi-component refrigerant confined in said refrigeration circuit and consisting of two refrigerants of different boiling temperatures.

10. A heat pump type refrigerant system as claimed in claim 9, wherein said refrigerants constituting said bi-component refrigerant are R22 and R13B1.

11. A heat pump type refrigeration system as claimed in claim 9, wherein said refrigerant tank is mounted in contact with said pipe.

12. A heat pump type refrigeration system as claimed in claim 9, wherein said refrigerant tank is disposed to surround the outer periphery of said pipe.

* * * * *